US009875702B2

(12) United States Patent
Shao et al.

(10) Patent No.: US 9,875,702 B2
(45) Date of Patent: Jan. 23, 2018

(54) PIXEL STRUCTURE, METHOD FOR DRIVING PIXEL STRUCTURE, DISPLAY PANEL AND DISPLAY DEVICE

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventors: Xianjie Shao, Beijing (CN); Xiaohe Li, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 16 days.

(21) Appl. No.: 15/098,414

(22) Filed: Apr. 14, 2016

(65) Prior Publication Data

US 2016/0307538 A1 Oct. 20, 2016

(30) Foreign Application Priority Data

Apr. 15, 2015 (CN) ..... 2015 1 0179196

(51) Int. Cl.
*G09G 3/36* (2006.01)

(52) U.S. Cl.
CPC ..... *G09G 3/3614* (2013.01); *G09G 3/3685* (2013.01); *G09G 2300/0426* (2013.01);
(Continued)

(58) Field of Classification Search
CPC .. G06F 3/038; G09G 5/00; G09G 3/36; G02F 1/1343
See application file for complete search history.

(56) References Cited

U.S. PATENT DOCUMENTS 8,299,992 B2 * 10/2012 Chen ..... G09G 3/3648 345/87
2006/0164350 A1 7/2006 Kim et al.
(Continued)

FOREIGN PATENT DOCUMENTS

CN 1808250 A 7/2006
CN 102116953 B 9/2012
(Continued)

OTHER PUBLICATIONS

First Office Action for Chinese Application No. 201510179196.X, dated Mar. 3, 2017, 7 pages.

*Primary Examiner* — Pegeman Karimi
(74) *Attorney, Agent, or Firm* — Brooks Kushman P.C.

(57) ABSTRACT

The present disclosure provides a pixel structure, a method for driving the pixel structure, a display panel and a display device. The pixel structure includes M gate lines, N data lines, and pixel units arranged in an array of M rows and N columns. Each pixel unit includes a pixel electrode and a thin film transistor (TFT), a drain electrode of the TFT is connected to the pixel electrode. Both M and N are positive integers. Source electrodes of the TFTs included in two adjacent pixel units in each row of the array are connected to two adjacent data lines respectively, and source electrodes of the TFTs included in two adjacent pixel units in each column of the array are connected to two adjacent data lines respectively.

14 Claims, 2 Drawing Sheets

(52) U.S. Cl.
CPC ..... *G09G 2310/0218* (2013.01); *G09G 2330/021* (2013.01)

(56) References Cited

U.S. PATENT DOCUMENTS

| | | | | |
|---|---|---|---|---|
| 2006/0203172 | A1* | 9/2006 | Baek | G02F 1/1368 349/146 |
| 2008/0036721 | A1 | 2/2008 | Kim et al. | |
| 2010/0149142 | A1* | 6/2010 | Hsu | G09G 3/3614 345/205 |
| 2011/0187682 | A1* | 8/2011 | Kim | G09G 5/00 345/204 |
| 2012/0169677 | A1 | 7/2012 | Lai et al. | |
| 2012/0217514 | A1* | 8/2012 | Joo | G02F 1/136213 257/88 |
| 2014/0125647 | A1* | 5/2014 | Shin | G09G 3/3648 345/212 |
| 2016/0005366 | A1 | 1/2016 | Fang et al. | |

FOREIGN PATENT DOCUMENTS

| | | | |
|---|---|---|---|
| CN | 103901689 | A | 7/2014 |
| JP | 2007047349 | A | 2/2007 |

* cited by examiner

PIXEL STRUCTURE, METHOD FOR DRIVING PIXEL STRUCTURE, DISPLAY PANEL AND DISPLAY DEVICE

CROSS-REFERENCE TO RELATED APPLICATION

The present application claims a priority of the Chinese patent application No. 201510179196.X filed on Apr. 15, 2015, which is incorporated herein by reference in its entirety.

TECHNICAL FIELD

The present disclosure relates to the field of display technology, in particular to a pixel structure, a method for driving the pixel structure, a display panel and a display device.

BACKGROUND

Along with the development of the liquid crystal display technology, a liquid crystal display panel has been widely used in such devices as a television, a display, a portable computer, a flat-panel computer and a mobile phone due to its advantages such as long service life, small size and low power consumption. Usually, the liquid crystal display panel is driven, depending on inversion of polarities, in a time frame inversion mode, a column inversion mode, a row inversion mode and a dot inversion mode. When it is driven in the dot inversion mode, it is able for the liquid crystal display panel to provide the best image quality, but the resultant power consumption is relatively high.

As shown in FIG. 1, which shows a conventional array substrate, each data line is configured to control pixels in one column of an array, and each gate line is configured to control the pixels in one row of the array. When it is necessary to display an image, one gate line is enabled, so as to turn on thin film transistors in a current row corresponding to the gate line, and charge the pixels in the current row via a data voltage applied to the data lines. When the pixels in a next row are being scanned, gate voltages corresponding to the pixels in the other rows are disabled, and thin film transistors (TFTs) in the current row are turned off, so as to maintain the voltage applied onto the pixels in the current row. At this time, a gate line corresponding to the pixels in the next row is enabled, so as to turn on the TFTs in the next row corresponding to the gate line, and charge the pixels in the next row via the data voltage applied to the data lines. For the dot inversion mode, it is necessary to invert a polarity of the data voltage applied to the data line. As shown in FIG. 2, the polarity of the data voltage applied to the data line needs to be inverted each time the pixels in one row are scanned by the gate line, so the resultant power consumption is very high.

SUMMARY

A main object of the present disclosure is to provide a pixel structure, a method for driving the pixel structure, a display panel and a display device, so as to reduce the power consumption of the display panel in the dot inversion driving mode.

In one aspect, the present disclosure provides in some embodiments a pixel structure, including M gate lines, N data lines, and pixel units arranged in an array of M rows and N columns, M and N being both positive integers, wherein each pixel unit includes a pixel electrode and a TFT, a drain electrode of the TFT is connected to the pixel electrode, source electrodes of the TFTs included in two adjacent pixel units in each row of the array are connected to two adjacent data lines respectively, and source electrodes of the TFTs included in two adjacent pixel units in each column of the array are connected to two adjacent data lines respectively.

Alternatively, gate electrodes of the TFTs included in the pixel units in each row of the array are connected to an identical gate line.

Alternatively, when M is an odd number, the source electrode of the TFT included in the pixel unit in an $n^{th}$ column and in each odd-numbered row is connected to an $n^{th}$ data line, and the source electrode of the TFT included in the pixel unit in the $n^{th}$ column and in each even-numbered row is connected to an $(n-1)^{th}$ data line, where n is a positive integer less than or equal to N.

Alternatively, when M is an odd number, the source electrode of the TFT included in the pixel unit in an $n^{th}$ column and in each odd-numbered row is connected to an $n^{th}$ data line, and the source electrode of the TFT included in the pixel unit in the $n^{th}$ column and in each even-numbered row is connected to an $(n+1)^{th}$ data line, where n is a positive integer less than or equal to N.

Alternatively, when M is an even number, apart from the pixel units in the last row, the source electrode of the TFT included in the pixel unit in an $n^{th}$ column and in each odd-numbered row is connected to an $n^{th}$ data line, the source electrode of the TFT included in the pixel unit in the $n^{th}$ column and in each even-numbered row is connected to an $(n-1)^{th}$ data line, and the source electrodes of the TFTs included in the pixel units in the last row are connected to an $(n+1)^{th}$ data line, where n is a positive integer less than or equal to N.

Alternatively, when M is an even number, apart from the pixel units in the last row, the source electrode of the TFT included in the pixel unit in an $n^{th}$ column and in each odd-numbered row is connected to an $n^{th}$ data line, the source electrode of the TFT included in the pixel unit in the $n^{th}$ column and in each even-numbered row is connected to an $(n+1)^{th}$ data line, and the source electrodes of the TFTs included in the pixel units in the last row are connected to an $(n-1)^{th}$ data line, where n is a positive integer less than or equal to N.

In another aspect, the present disclosure provides in some embodiments a method for driving the above-mentioned pixel structure, including steps of maintaining a polarity of a data voltage applied to each data line one time frame, and inverting the polarity of the data voltage applied to the data line within an adjacent time frame.

In yet another aspect, the present disclosure provides in some embodiments a display panel including the above-mentioned pixel structure.

In still yet another aspect, the present disclosure provides in some embodiments a display device including the above-mentioned display panel.

According to the pixel structure, the method for driving the pixel structure, the display panel and the display device in the embodiments of the present disclosure, it is able to achieve the dot inversion merely by changing the polarity of the data voltage applied to the data line once within one time frame, i.e., to achieve a dot inversion effect in a column inversion mode, thereby to remarkably reduce the power consumption.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION OF THE EMBODIMENTS

Figure 1:
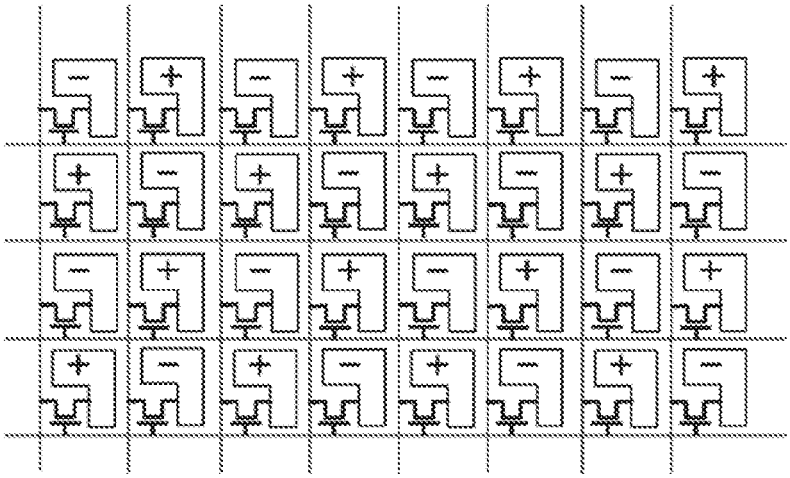
FIG. 1 is a schematic view showing a conventional pixel structure.
Figure 2:
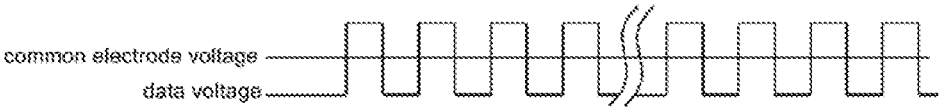
FIG. 2 is a sequence diagram of a data voltage for the conventional pixel structure.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

The present disclosure provides in some embodiments a pixel structure, which includes M gate lines, N data lines, and pixel units arranged in an array of M rows and N columns. Each pixel unit includes a pixel electrode and a TFT, a drain electrode of the TFT is connected to the pixel electrode. Both M and N are positive integers. Source electrodes of the TFTs included in two adjacent pixel units in each row of the array are connected to two adjacent data lines respectively, and source electrodes of the TFTs included in two adjacent pixel units in each column of the array are connected to two adjacent data lines respectively.

According to the pixel structure in the embodiments of the present disclosure, it is able to achieve the dot inversion merely by changing the polarity of the data voltage applied to the data line once within one time frame, i.e., to achieve a dot inversion effect in a column inversion mode, thereby to remarkably reduce the power consumption.

Alternatively, gate electrodes of the TFTs included in the pixel units in each row of the array are connected to, i.e., controlled by, an identical gate line.

Alternatively, when M is an odd number, the source electrode of the TFT included in the pixel unit in an $n^{th}$ column and in each odd-numbered row is connected to an $n^{th}$ data line, and the source electrode of the TFT included in the pixel unit in the $n^{th}$ column and in each even-numbered row is connected to an $(n-1)^{th}$ data line.

Alternatively, when M is an odd number, the source electrode of the TFT included in the pixel unit in an $n^{th}$ column and in each odd-numbered row is connected to an $n^{th}$ data line, and the source electrode of the TFT included in the pixel unit in the $n^{th}$ column and in each even-numbered row is connected to an $(n+1)^{th}$ data line.

Alternatively, when M is an even number, apart from the pixel units in the last row, the source electrode of the TFT included in the pixel unit in an $n^{th}$ column and in each odd-numbered row is connected to an $n^{th}$ data line, and the source electrode of the TFT included in the pixel unit in the $n^{th}$ column and in each even-numbered row is connected to an $(n-1)^{th}$ data line. The source electrodes of the TFTs included in the pixel units in the last row are connected to an $(n+1)^{th}$ data line.

Alternatively, when M is an even number, apart from the pixel units in the last row, the source electrode of the TFT in the pixel unit included in an $n^{th}$ column and m in each odd-numbered row is connected to an $n^{th}$ data line, and the source electrode of the TFT in the pixel unit included in then column and in each even-numbered row is connected to $(n+1)^{th}$ data line. The source electrodes of the TFTs included in the pixel units in the last row are connected to an $(n-1)^{th}$ data line.

The present disclosure will be described hereinafter in conjunction with the drawings and embodiments.

Figure 3A:
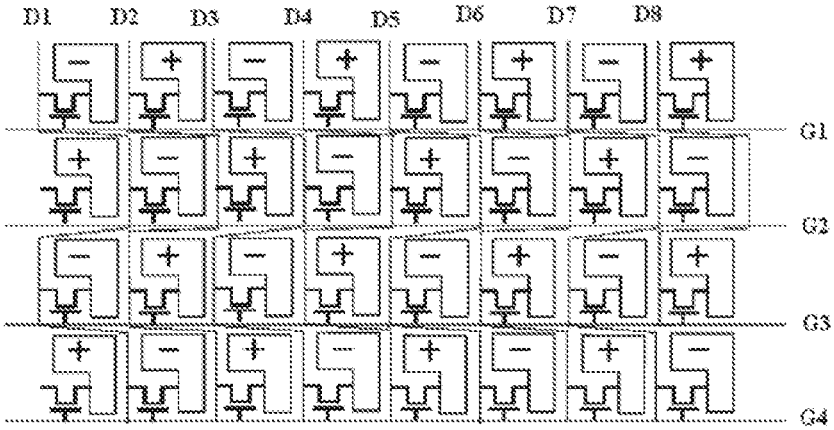
FIG. 3A is a schematic view showing a pixel structure according to some embodiments of the present disclosure.

As shown in FIG. 3A, in some embodiments of the present disclosure, the pixel structure includes four gate lines (G1, G2, G3 and G4), eight data lines (D1, D2, D3, D4, D5, D6, D7 and D8), and the pixel units arranged in an array of 4 row and 8 columns. Each pixel unit includes a pixel electrode and a TFT, a drain electrode of which is connected to the pixel electrode. The source electrode of the TFT included in the pixel unit in an $n^{th}$ column and in each odd-numbered row is connected to an $n^{th}$ data line, and the source electrode of the TFT included in the pixel unit in the $n^{th}$ column and in each even-numbered row is connected to an $(n-1)^{th}$ data line, where n is a positive integer less than or equal to N.

Figure 3B:
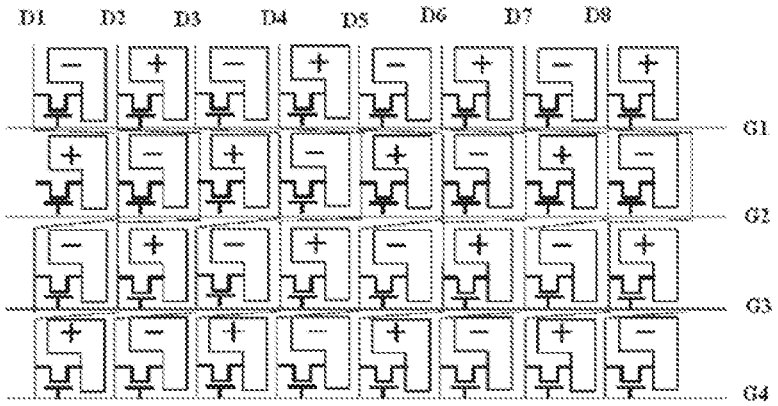
FIG. 3B is a schematic view showing the pixel structure according to some other embodiments of the present disclosure.

As shown in FIG. 3B, in some other embodiments, the pixel structure includes four gate lines (G1, G2, G3 and G4), eight data lines (D1, D2, D3, D4, D5, D6, D7 and D8), and the pixel units arranged in an array of 4 rows and 8 columns. Each pixel unit includes a pixel electrode and a TFT, a drain electrode of which is connected to the pixel electrode. The source electrode of the TFT included in the pixel unit in an $n^{th}$ column and in a first row is connected to an $n^{th}$ data line, the source electrode of the TFT included in the pixel unit in the $n^{th}$ column and in a third row is connected to the $n^{th}$ data line, the source electrode of the TFT included in the pixel unit in the $n^{th}$ column and in a second row is connected to an $(n-1)^{th}$ data line, and the source electrode of the TFT included in the pixel unit in the $n^{th}$ column and in a fourth row is connected to an $(n+1)^{th}$ data line, where n is a positive integer less than or equal to 8. In FIG. 3B, each pixel electrode is arranged on the right side of the corresponding TFT.

Figure 3C:
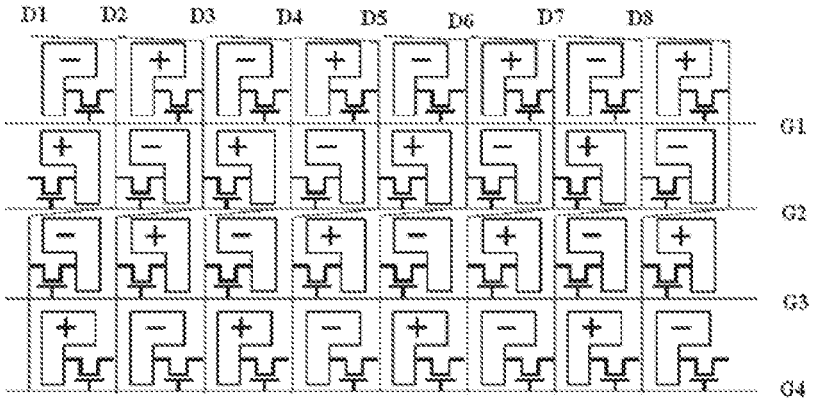
FIG. 3C is a schematic view showing the pixel structure according to some other embodiments of the present disclosure.

As shown in FIG. 3C, in some other embodiments, as compared with the pixel structure in FIG. 3B, the pixel electrodes of the pixel units in the first row and the fourth row are arranged on the left side of the corresponding TFTs respectively, and the pixel electrodes of the pixel units in the second row and the third row are arranged on the right side of the corresponding TFTs respectively, so as to facilitate the connection of the pixel electrodes to the data lines.

In FIGS. 3A, 3B and 3C, gate electrodes of the TFTs included in the pixel units in each row are connected to an identical gate line.

In the embodiments of the present disclosure, during the design, each data line is connected to the pixel electrodes each with a pixel electrode signal "−" or each with a pixel electrode signal "+" via the TFTs.

Figure 4:
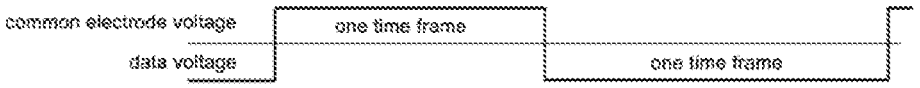
FIG. 4 is a sequence diagram of a data voltage for the pixel structure according to some other embodiments of the present disclosure.

For example, the first data line D1 is connected to the pixel electrodes each with a pixel electrode signal "−" via the TFTs, the second data line D2 is connected to the pixel electrodes each with a pixel electrode signal "+" via the TFTs, . . . , the seventh data line D7 is connected to the pixel electrodes each with a pixel electrode signal "−" via the TFTs, and the eighth data line D8 is connected to the pixel electrodes each with a pixel electrode signal "+" via the TFTs. At this time, the TFTs are connected in an S-shaped manner, so the inversion mode herein is also called as S-shaped inversion mode. It can be seen that, the pixel electrode signals of the pixel electrodes connected to each data line via the TFTs have an identical polarity, and the data voltages applied to the adjacent data lines have the polarities opposite to each other. Hence, as shown in FIG. 4, when the pixel units are progressively scanned by the gate lines within one time frame, it is unnecessary to invert the polarity of the data voltage applied to the data line, and it is merely necessary to adjust the data voltage with the same polarity, so it is able to remarkably reduce the power consumption. In some embodiments of the present disclosure, in the case that the display effect is not adversely affected, the power consumption may be reduced by about 30%.

The present disclosure further provides in some embodiments a display panel including the above-mentioned pixel structure.

The present disclosure further provides in some embodiments a display device including the above-mentioned display panel.

The present disclosure further provides in some embodiments a method for driving the above-mentioned pixel structure. The method includes steps of maintaining a polarity of a data voltage applied to each data line within one time frame, and inverting the polarity of the data voltage applied to the data line within an adjacent time frame.

According to the driving method in the embodiments of the present disclosure, when the pixel units are progressively scanned by the gate lines within one time frame, it is necessary to invert the polarity of the data voltage applied to the data line, and it is merely necessary to adjust the data voltage with the same polarity, so it is able to remarkably reduce the power consumption.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A pixel structure, comprising M gate lines, N data lines, and pixel units arranged in an array of M rows and N columns, where M and N are both positive integers, wherein each pixel unit comprises a pixel electrode and a thin film transistor (TFT), and a drain electrode of the TFT is connected to the pixel electrode, source electrodes of the TFTs comprised in two adjacent pixel units in each row of the array are connected to two adjacent data lines respectively, and source electrodes of the TFTs comprised in two adjacent pixel units in each column of the array are connected to two adjacent data lines respectively, wherein in the case that M is an even number, apart from the pixel units in the last row of the array, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n-1)^{th}$ data line, and the source electrodes of the TFTs comprised in the pixel units in the last row of the array are connected to an $(n+1)^{th}$ data line, where n is a positive integer less than or equal to N; or in the case that M is an even number, apart from the pixel units in the last row of the array, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n+1)^{th}$ data line, and the source electrodes of the TFTs comprised in the pixel units in the last row of the array are connected to an $(n-1)^{th}$ data line, where n is a positive integer less than or equal to N.

2. The pixel structure according to claim 1, wherein gate electrodes of the TFTs comprised in the pixel units in each row of the array are connected to an identical gate line.

3. The pixel structure according to claim 2, wherein in the case that M is an odd number, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n-1)^{th}$ data line, where n is a positive integer less than or equal to N.

4. The pixel structure according to claim 2, wherein in the case that M is an odd number, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n+1)^{th}$ data line, where n is a positive integer less than or equal to N.

5. The pixel structure according to claim 1, wherein in the case that M is an odd number, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n-1)^{th}$ data line, where n is a positive integer less than or equal to N.

6. The pixel structure according to claim 1, wherein in the case that M is an odd number, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n+1)^{th}$ data line, where n is a positive integer less than or equal to N.

7. A method for driving the pixel structure according to claim 1, comprising steps of:

maintaining a polarity of a data voltage applied to each data line within one time frame, and inverting the polarity of the data voltage applied to the data line within an adjacent time frame.

8. A display panel, comprising the pixel structure according to claim 1.

9. The display panel according to claim 8, wherein gate electrodes of the TFTs comprised in the pixel units in each row of the array are connected to an identical gate line.

10. The display panel according to claim 9, wherein in the case that M is an odd number, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n-1)^{th}$ data line, where n is a positive integer less than or equal to N.

11. The display panel according to claim 9, wherein in the case that M is an odd number, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n+1)^{th}$ data line, where n is a positive integer less than or equal to N.

12. The display panel according to claim 8, wherein in the case that M is an odd number, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n-1)^{th}$ data line, where n is a positive integer less than or equal to N.

13. The display panel according to claim 8, wherein in the case that M is an odd number, the source electrode of the TFT comprised in the pixel unit in an $n^{th}$ column and in each odd-numbered row of the array is connected to an $n^{th}$ data line, and the source electrode of the TFT comprised in the pixel unit in the $n^{th}$ column and in each even-numbered row of the array is connected to an $(n+1)^{th}$ data line, where n is a positive integer less than or equal to N.

14. A display device, comprising the display panel according to claim 8.

* * * * *